US007665337B1

(12) United States Patent
Widen

(10) Patent No.: US 7,665,337 B1
(45) Date of Patent: Feb. 23, 2010

(54) PROFILED KEY FOR CYLINDER LOCKS

(75) Inventor: Bo Widen, Torshilla (SE)

(73) Assignee: Winloc AG, Zug Schweiz (CH)

( * ) Notice: Subject to any disclaimer, the term of this patent is extended or adjusted under 35 U.S.C. 154(b) by 0 days.

(21) Appl. No.: 12/388,043

(22) Filed: Feb. 18, 2009

(51) Int. Cl.
*E05B 19/06* (2006.01)

(52) U.S. Cl. ..... 70/409; 70/493; 70/495

(58) Field of Classification Search ..... 70/405–407, 70/409, 492–495
See application file for complete search history.

(56) References Cited

U.S. PATENT DOCUMENTS 4,638,651 A * 1/1987 Surko, Jr. ..... 70/495
5,640,865 A * 6/1997 Widen ..... 70/495
5,715,717 A * 2/1998 Widen ..... 70/493
5,809,816 A * 9/1998 Widen ..... 70/493
6,851,292 B2 * 2/2005 Kruhn ..... 70/409
7,159,424 B2 * 1/2007 Widen ..... 70/409
7,487,653 B2 * 2/2009 Widen ..... 70/409

* cited by examiner

*Primary Examiner*—Suzanne D Barrett
(74) *Attorney, Agent, or Firm*—Birch, Stewart, Kolasch & Birch, LLP

(57) ABSTRACT

A key for use in a cylinder lock with a rotatable key plug having a profiled keyway including a longitudinal profile rib at a side wall of the keyway. The key has an elongated, substantially flat key blade (120; 120') having a longitudinal profile groove (122; 122') extending along at least a portion of the length of the key blade. The groove has an undercut portion (129) adjacent to a ridge portion (128, 128'), the outside of which forms part of a side surface (123; 123') of the key blade and the inside of which comprises a side wall portion (126; 126') being inclined and facing the bottom wall (124; 124') of the groove. The undercut portion (129; 129') of the groove is expanded, at its innermost part adjacent to the inclined side wall portion (126; 126'), into a longitudinally extending pocket (135; 135').

18 Claims, 5 Drawing Sheets

PROFILED KEY FOR CYLINDER LOCKS

FIELD AND BACKGROUND OF THE INVENTION

The present invention relates to a key for use in a cylinder lock with a rotatable key plug having a profiled keyway including a longitudinal profile rib at at least one sidewall of the keyway, said key comprising:

an elongated, substantially flat key blade having a longitudinal profile groove extending along at least a portion of the length of the key blade, with a bottom wall of said groove being substantially parallel to a side surface of said flat key blade, said longitudinal profile groove having an undercut portion adjacent to a ridge portion, the outside of which forms part of a side surface of the key blade and the inside of which comprises a sidewall portion being inclined and facing said bottom wall of said groove.

Such a key with an undercut groove is previously known, e.g. from U.S. Pat. No. 5,715,717 (Widén) or U.S. Pat. No. 5,640,865 (Widén). Such keys have proven to be very useful in that they provide an improved security. The key profile is quite distinguished from conventional keys, and it is rather difficult to copy such keys. Moreover, they permit a great variation of the cross-sectional profile, which is a great advantage.

OBJECT OF THE INVENTION

However, over time, there is a constant need for further distinguishing profiles and many more possible variations thereof.

A further object of the invention is to make it even more difficult to copy such profiled keys with ordinary lock smith tools.

SUMMARY OF THE INVENTION

In order to achieve these objects, a key according to the present invention is provided with an undercut groove, a portion of which is expanded, at its innermost part adjacent to an inclined surface wall portion, into a longitudinally extending pocket comprising opposite lateral walls and a lowermost wall, one of these opposite lateral walls of the pocket forming an inside wall of a ridge portion. This inside wall of the ridge portion may be substantially parallel to a side surface of the key blade, so that the ridge portion forms a massive and strong material portion extending in parallel to the side surface of the key blade. The pocket inside the ridge portion may have a rectangular cross-section.

In this way, the material of the key blade is used in an optimum way, and a new kind of profile is obtained, and it will be very difficult to copy such keys, especially if they are produced by stamping and milling. A cutting disc is not enough. Rather, it will be necessary to use broaching tools and a well-controlled use of such tools in order to secure exact dimensions of the pocket-like extension of the groove. This is of great importance for key control and high security to the end user of the key.

With such a configuration of the undercut groove, many advantages are obtained at the same time, as will be explained further below.

Other preferable features are stated in the dependent claims and will appear from the detailed description below.

BRIEF DESCRIPTION OF THE DRAWINGS

The invention will be described more fully below with reference to the appended drawings.

BRIEF DESCRIPTION OF SOME PREFERRED EMBODIMENTS

Figure 1:
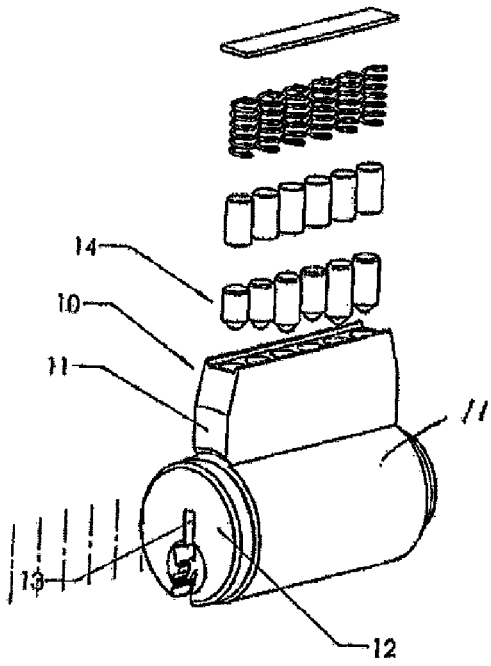
FIG. 1 and FIG. 2 illustrate a prior art lock and key combination.
Figure 2:
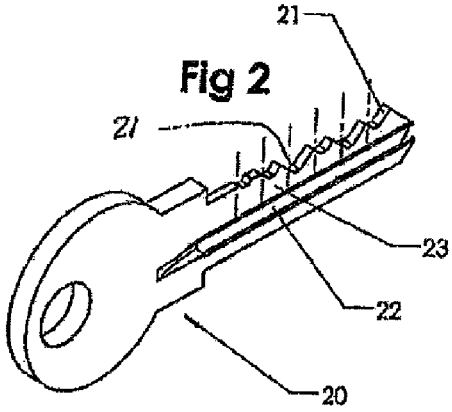
Figure 3:
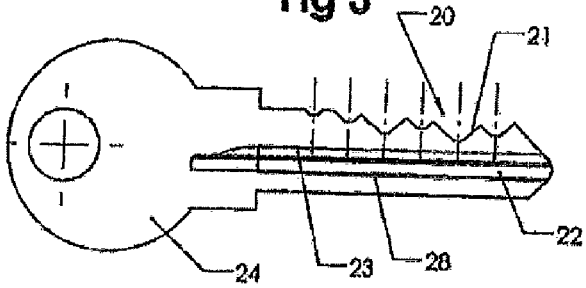
FIG. 3 shows a side view of the key illustrated in FIG. 2.

FIGS. 1 through 5 show a prior art lock and key system with a key blade having an undercut profile groove in a side surface thereof, such as the system disclosed in U.S. Pat. No. 5,715,717 (Widén). The lock 10 is of the kind having a housing 11 with a rotatable key plug 12 accommodated in a cylindrical bore of the housing. In the key plug 12, there is a central longitudinal keyway 13 having a sectional profile corresponding to an associated key 20 provided with conventional recesses 21 at the upper edge thereof and a profile groove 22 at a side surface 23 of the key blade. As appears from FIG. 3, the key also has a grip portion 24.

Figure 4:
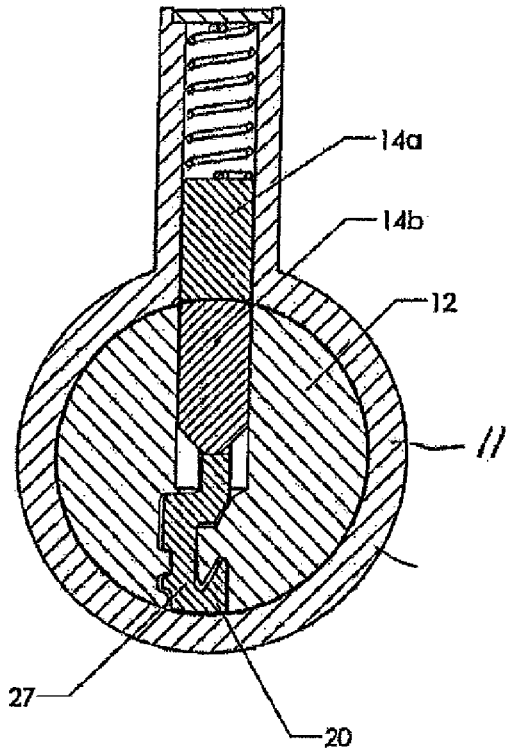
FIG. 4 is a cross-section through the prior art lock with an inserted key.

The operation of the lock is more readily understood from the cross-sectional view in FIG. 4. The key plug 12 is rotatable within the housing 11 and can be locked against rotation by means of a longitudinal row of upper and lower locking pins 14*a*, 14*b*. Each pair of such locking pins can be positioned with their abutting end surfaces at the shear line between the key plug 12 and the housing 11. In this position, as shown in FIG. 4, the key plug 12 is rotatable. Here, as is well-known in the art, the locking pins are positioned so as to release the lock by means by a properly cut key 20.

Figure 5:
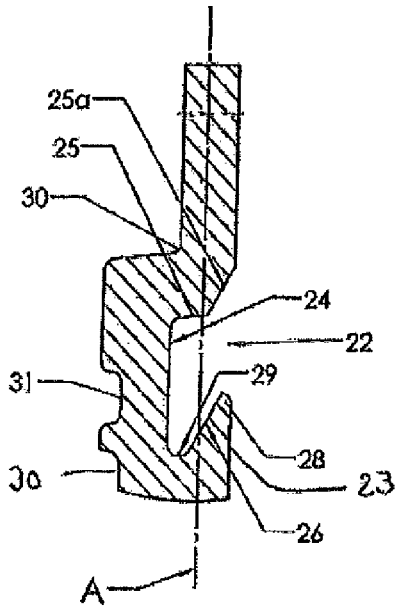
FIG. 5 is a cross-sectional view of the prior art key blade.

The full profile of the key 20 (of prior art design) is illustrated in FIG. 5, as disclosed e.g. in the above-mentioned U.S. Pat. No. 5,715,717 (Widén). Accordingly, this prior art key has a longitudinal profile groove 22 extending longitudinally along the key blade at a depth which is slightly greater than half the thickness of the key blade. In FIG. 5, the central plane of the key blade is denoted "A". The longitudinal groove 22 has a bottom wall 24 and opposite side walls 25 and 26. One of these opposite walls, in particular the wall or surface 26 located closest to the base edge 27 of the key blade is undercut and extends in a plane being inclined so as to face inwardly towards the bottom wall or surface 24. This lower side wall 26 of the undercut groove 22 forms an inside wall of a ridge portion 28, the outside of which forms part of the above mentioned side surface 23 of the key blade.

The prior art key blade shown in FIGS. 2, 3, 4 and 5 also has two further longitudinal grooves 30 and 31 on the other side of the key (to the left in FIG. 5).

The undercut portion 29 of the longitudinal groove 22 has many advantages, as explained in the above-mentioned U.S. Pat. No. 5,715,717 (Widén), especially with regard to increasing the number of possible profile variations, improved resistance against picking the lock and high security against unauthorized key copying.

According to the present invention and as illustrated in FIGS. 6 through 9, a further improvement resides in a modification of the undercut groove. This modification comprises an expansion or extension of the innermost part of the undercut portion of the groove 122 (FIG. 7) so as to form a longitudinal pocket-like configuration 135. In these figures, all reference numerals relating to the key correspond to those shown in FIG. 5, although they have been supplemented with the digit "1" before the number given in FIG. 5.

The downwardly extended pocket-like configuration 135 of the modified undercut groove 122, is (in this particular embodiment) substantially rectangular in cross-section, with opposite lateral walls 132 and 133 being parallel to each other, and a lowermost wall 134, being parallel to the lower edge surface of the key blade and facing upwardly in the direction of the central plane A of the key blade.

The innermost lateral wall 132 of the pocket-like extension 135 adjoins with the bottom wall 124 of the undercut groove, but is slightly displaced inwardly (away from the groove opening) so as to form a step 136, whereas the opposite lateral wall 133 forms the inside wall of the ridge portion 128, in parallel to the external side surface 123 of the key blade.

Thus, the surfaces 123, 133 and 132 are substantially parallel to each other.

The ridge portion 128 is somewhat longer, measured in parallel to the central plane A of the key blade, than the prior art structure (FIG. 5). More particularly, the ridge portion 128 has a vertical dimension h, which is more than half of the smallest width w of the undercut groove 122, this smallest width w being measured as a perpendicular projection onto the bottom wall 124 of the longitudinal groove 122. This structure is advantageous for several reasons:

- by varying the width, depth (in the plane A) and longitudinal extension of the pocket-like configuration, the profile shape can be varied considerably;
- because of the opposite lateral wall portions 132, 133, the total width of the undercut portion of the profile groove 122 can be accommodated in a limited region laterally, so that the total width of the key blade can be kept rather small. It appears from FIGS. 5 and 7 that the total width of the new key blade is about the same;
- the corresponding tongue portion, which forms a part of a longitudinal rib 150 at a side wall of the key way (see FIGS. 8 and 9), will be stronger and does not have to have a pointed or sharp end portion, as in the prior art structure (compare FIG. 4);
- the pocket-like extension 135 of the undercut portion of the groove 122 will make it much more difficult to make copies of such keys, since it is not sufficient to use only a cutter disk. Other tools also have to be used. Accordingly it will be difficult for others than specialized manufacturers to produce such key blanks;
- the relatively long vertical extension of the ridge portion 128, in parallel to the central plane A of the key blade, will make it possible to cut rather deep recesses in the ridge portion. Accordingly, just like in the prior art embodiment of FIG. 1-5, it is possible to provide many vertical levels of code recesses in this material region, see FIG. 6. Of course, this will also facilitate lock and key systems having a very high number of code combinations.

Figure 8:
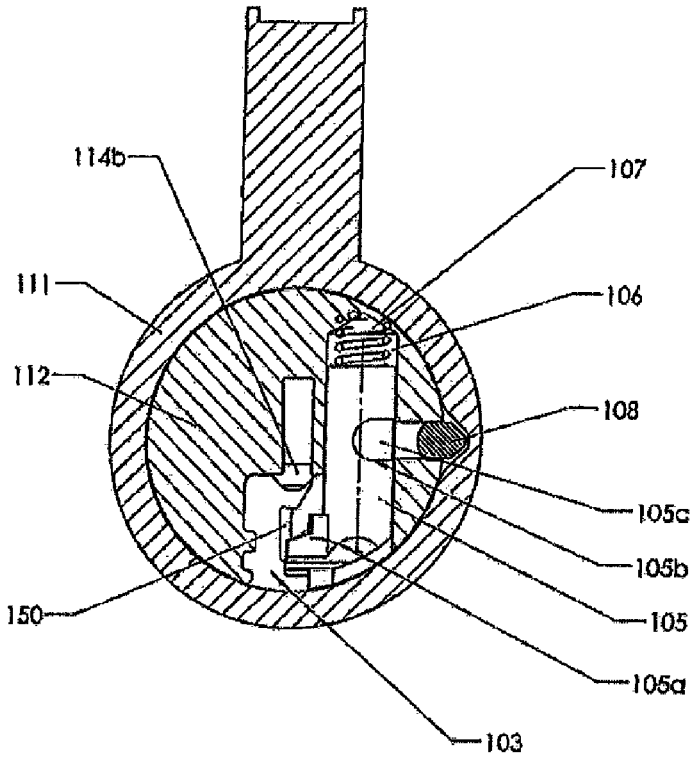
FIG. 8 is a cross-section through an associated lock with a key plug and a side tumbler.
Figure 9:
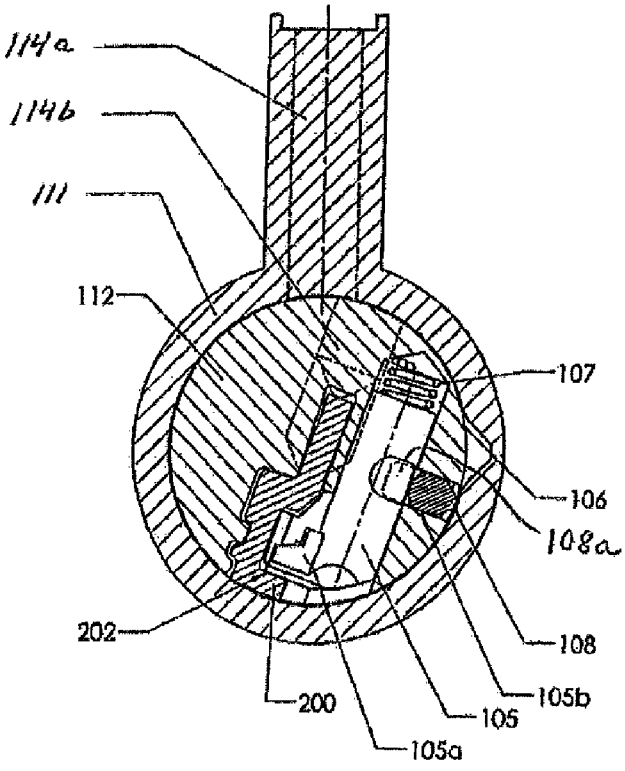
FIG. 9 is a similar view of a lock and an inventive key inserted into the lock.

In FIGS. 8 and 9 there is shown an embodiment with a side locking tumbler 105, which is guided in a cylindrical cavity 106 in the rotatable key plug 112. In principle, the arrangement is similar to those disclosed in the U.S. Pat. Nos. 4,756,177 (Widén) and 5,715,717 (Widén).

The parts that correspond to the previous, prior art embodiment (FIG. 5) have been given the same reference numerals, with the digit "1" added before the numbers shown in FIG. 5.

Figure 6:
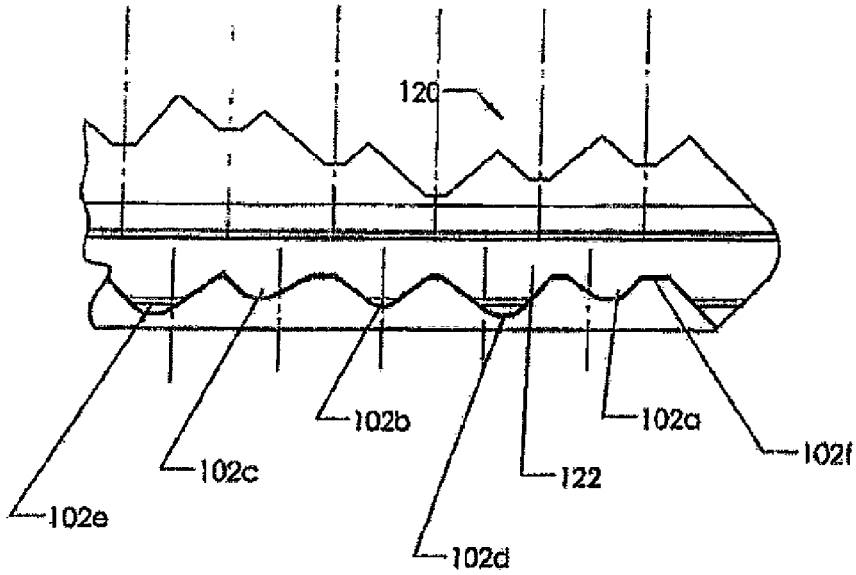
FIG. 6 shows a side view of a profiled key according to the present invention for an embodiment with a wave-like code pattern.
Figure 7:
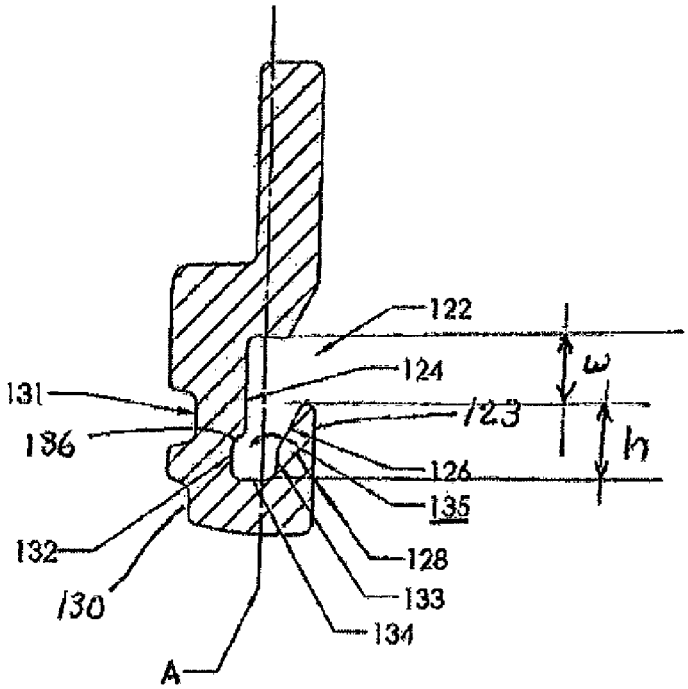
FIG. 7 is a cross-section through the key of FIG. 6.

Accordingly, the side tumbler 105 is rotatable around its cylindrical axis, so that a transversally projecting finger 105*a* will pivot back and forth when the projecting finger 105*a* follows a wave-like coded surface on the side of the key blade (see FIG. 6), in this case in the ridge portion 128 (see FIG. 7). When the side tumbler 105 is correctly positioned, a recess 105*b* in its cylindrical surface will register with corresponding projections 108*a* on a side bar 108. In this way, the side bar may move radially inwards so as to permit rotation of the key plug 112.

The projecting finger 105*a* on the side tumbler 105 will contact the wave-like code pattern on the side of the key blade 120, as shown in FIG. 6, while pivoting back and forth and also moving vertically up and down. When the key blade is fully inserted, the various side tumbler projections 105*a* will be located in the concavities 102*a*, 102*b*, 102*c*, 102*d*, 102*e* and possibly also (or alternatively) onto an upper code surface portion 102*f* at an uppermost extra code level. Such an upper, extra code level is disclosed in the published international patent application WO2005/028789 (Winloc et al).

It would be possible to provide an even deeper pocket-like extension 135 of the undercut portion of the profile groove, in parallel to the central vertical plane A of the key blade. Then, the number of possible code levels in the ridge portion 133 (see FIGS. 6 and 7) would be larger than in prior art structures.

It should be noted that the new configuration of the undercut groove 122, with the pocket-like extension 132, 133, 134, is useful even without having a side tumbler 105. Then, the ridge portion is basically continuous and does not have any cuts or codes.

Also, if one or more side tumbler is used, it does not have to be rotatable but can be guided for elevational movement only. Furthermore, the side tumbler does not have to operate as a locking means for locking the key plug against rotation. Alternatively, it may serve only as a blocking element, which prevents incorrectly cut keys from being fully inserted into the key way 13 of the lock 10. Such a blocking element is disclosed in a patent application being filed by the same applicant on the same day as the present application.

Figure 10:
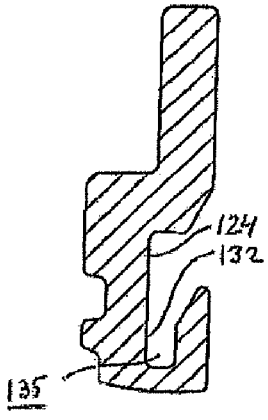
FIGS. 10-19 are cross-sectional views of some additional embodiments of the profiled key according to the invention.

The exact configuration or shape of the longitudinally extending pocket may be modified in various ways within the scope of the present invention. In FIG. 10, there is shown an embodiment where the bottom wall 124 of the longitudinal profile groove 122 merges smoothly with the adjoining lateral wall 132 of the pocket-like configuration 135, without any step (136 in FIG. 7).

Figure 11:
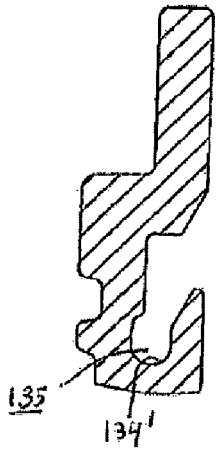

In FIG. 11, the pocket-like configuration 135 is similar to the one in FIG. 7, but the lowermost wall 134' is rounded or curved.

Figure 12:
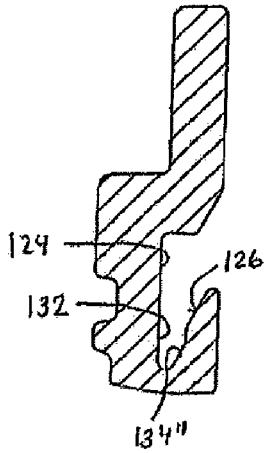

The embodiment shown in FIG. 12 is similar to the one in FIG. 10, but the lowermost wall 134" is slanted or inclined at an angle corresponding to the inclined surface 126. Thus, the slanted lowermost wall 134" faces the adjoining lateral wall 132 which adjoins the bottom wall 124.

Figure 13:
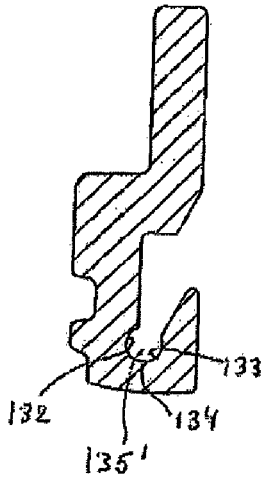

In FIG. 13, the pocket-like configuration 135' is modified into a circular cross-section. Accordingly, in this embodiment, the lateral walls 132, 133 and the lowermost wall 134 are all formed as circular arcs merging with each other.

Figure 14:
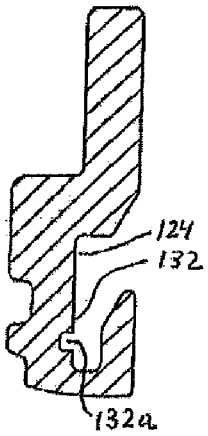

The embodiment shown in FIG. 14 is like the one shown in FIG. 10, but the lateral wall 132 adjoining the bottom wall 124 is provided with a longitudinal recess 132*a*, which is rectangular in cross-section.

Figure 15:
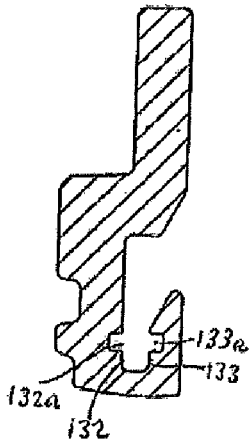

The embodiment of FIG. 15 is similar to the one of FIG. 14, but there is also a longitudinal recess 133*a* in the lateral wall 133 opposite to the longitudinal recess 132*a*.

Figure 16:
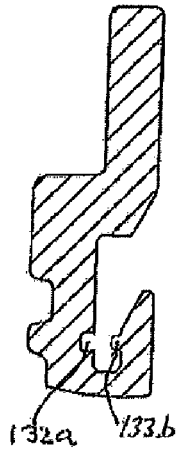

The embodiment shown in FIG. 16 is similar to the one in FIG. 15, but there is a longitudinal rib 133*b* (instead of a recess 133*a*) opposite to the longitudinal recess 132*a*.

Figure 17:
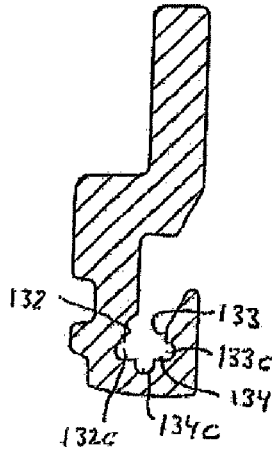

The modified embodiment shown in FIG. 17 comprises relatively small longitudinal recesses 132*c*, 133*c*, 134*c* with part-cylindrical cross-sections in the lateral walls 133 and 132 and the lowermost wall 134, respectively. Except for these part cylindrical recesses, this embodiment corresponds to the one shown in FIG. 10.

Figure 18:
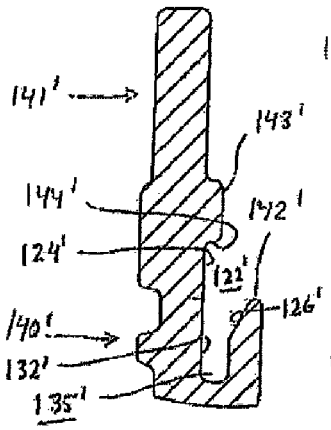
Figure 19:
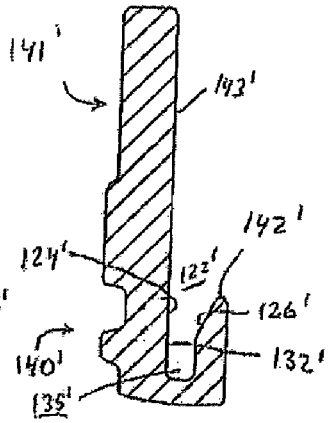

In the embodiments shown in FIGS. 18 and 19, the key blade 120' has a relatively wide lower portion 140' and a relatively narrow upper portion 141', there being a shelf or step surface 142' in the transition region between the wider lower portion 140' and the narrow upper portion 141'. In both embodiments, the longitudinal profile groove 122' is located adjacent to this shelf surface 142'. Like in the other embodiments shown in FIGS. 10-17, the longitudinal undercut groove 122' is extended, adjacent to its inclined side wall portion 126', into a pocket-like configuration 135'. In the shown embodiments, these pocket-like configurations are rectangular, but they may of course have any desired shape, as illustrated in the previous embodiments. In FIG. 18, the lateral wall 132' merges smoothly with the bottom wall 124' of the undercut groove 122', and the latter adjoins the associated side wall 143' of the upper, relatively narrow portion 141' of the key blade via a step 144'. In FIG. 19, on the other hand, there is no such step 144', and the lateral wall 132', the bottom wall 124' and the side wall 143' all merge smoothly into a common side surface.

In all embodiments described above, and in the appended claims, it is assumed that the bottom wall 124 of the longitudinal undercut groove 122 is substantially parallel to the central plane A of the key blade and a side surface 123 thereof. Within this definition, the bottom wall may be oriented at a small angle to said central plane A, this angle being no more than 15°.

The longitudinally extending pocket may be shorter than the key blade and extend along only a portion thereof.

Also, the longitudinal profile rib may be interrupted or formed as a separate element secured to the key plug.

The invention claimed is:

1. A key for use in a cylinder lock with a rotatable key plug having a profiled keyway including a longitudinal profile rib at at least one side wall of the key way, said key comprising:

an elongated, substantially flat key blade (120; 120') having a longitudinal profile groove (122; 122') extending along at least a portion of the length of the key blade, with a bottom wall (124; 124') of said groove being substantially parallel to a side surface (123; 123') of said flat key blade, said longitudinal profile groove having an undercut portion (129) adjacent to a ridge portion (128, 128'), the outside of which forms part of a side surface (123; 123') of the key blade and the inside of which comprises a side wall portion (126; 126') being inclined and facing said bottom wall (124; 124') of said groove, characterized in that said undercut portion (129; 129') of said longitudinal profile groove is expanded, at its innermost part adjacent to said inclined side wall portion (126; 126'), into a longitudinally extending pocket (135; 135'), said pocket comprises opposite lateral walls (132, 133) and a lowermost wall (134; 134'), and one of the opposite lateral walls (133; 133') of said pocket forms an inside wall of said ridge portion (128; 128');

wherein the vertical dimension (h) of said ridge portion (128), measured in a plane of said side surface of the key blade, is more than half of the smallest width (w) of said undercut groove adjacent to said side surface, said smallest width being measured as a perpendicular projection onto said bottom wall (124) of said longitudinal groove.

2. The key as defined in claim 1, wherein said pocket (135) has a substantially rectangular cross-section.

3. The key as defined in claim 1, wherein at least one of said opposite lateral wall and said lowermost wall (134') of said pocket is curved.

4. The key as defined in claim 3, wherein said pocket (135*a*) has a substantially circular cross-section.

5. The key as defined in claim 2, wherein said opposite lateral walls (132, 133) of said pocket are substantially parallel to said side surface (123) of the flat key blade.

6. The key as defined in claim 1, wherein said lowermost wall (134) of said pocket is substantially planar.

7. The key as defined in claim 1, wherein at least one of said opposite lateral wall and said lowermost wall is provided with an irregular surface portion (132*a*, 132*c*, 133*a*, 133*b*, 133*c*, 134*c*).

8. The key as defined in claim 1, wherein said bottom wall (124) of said longitudinal profile groove (122) merges with one of said opposite lateral walls (132) of said pocket.

9. The key as defined in claim 1, constituting a key blank with a continuous upper edge portion.

10. The key as defined in claim 1, having side coded recesses cut into said ridge portion, so as to form a side code on the key blade.

11. The key as defined in claim 10, wherein said side code recesses forming a side code constitute a wave-like, longitudinal code pattern.

12. The key as defined in claim 10, wherein said side code recesses are cut into the whole material thickness of said ridge portion, so that the side code recesses reach all the way from the outside surface of said ridge portion into said longitudinally extending pocket of the undercut profile groove.

13. The key as defined in claim 10, wherein said side code recesses are cut from an upper edge of the ridge portion down to various levels between said upper edge and the lowermost part of said longitudinally extending pocket.

14. The key as defined in claim 10, wherein said side code recesses form concavities with lower bottom portions located at a number of different levels, each representing a code.

15. The key as defined in claim 14, wherein said different levels also include an uppermost level at the upper edge of said ridge portion.

16. The key as defined in claim 1, wherein the bottom wall of said longitudinal profile groove and the adjoining longitudinally extending pocket are located at a depth from said side surface of the key blade which is greater than half the thickness of said key blade.

17. The key as defined in claim 1, wherein said substantially flat key blade has a massive, relatively wide lower portion (140'), in which said longitudinal profile groove (122') is located, and an upper, relatively narrow upper portion (141').

18. A key for use in a cylinder lock with a rotatable key plug having a profiled keyway including a longitudinal profile rib at at least one side wall of the key way, said key comprising:

an elongated, substantially flat key blade (120; 120') having a longitudinal profile groove (122; 122') extending along at least a portion of the length of the key blade, with a bottom wall (124; 124') of said groove being substantially parallel to a side surface (123; 123') of said flat key blade, said longitudinal profile groove having an undercut portion (129) adjacent to a ridge portion (128, 128'), the outside of which forms part of a side surface (123; 123') of the key blade and the inside of which comprises a side wall portion (126; 126') being inclined and facing said bottom wall (124; 124') of said groove, characterized in that said undercut portion (129; 129') of said longitudinal profile groove is expanded, at its innermost part adjacent to said inclined side wall portion (126; 126'), into a longitudinally extending pocket (135; 135'), said pocket comprises opposite lateral walls (132, 133) and a lowermost wall (134; 134'), and one of the opposite lateral walls (133; 133') of said pocket forms an inside wall of said ridge portion (128; 128');

wherein at least one of said opposite lateral wall and said lowermost wall (134') of said pocket is curved and wherein said pocket (135*a*) has a substantially circular cross-section.

* * * * *